United States Patent [19]

Behr

[11] 4,081,138

[45] Mar. 28, 1978

[54] NOZZLE CONSTRUCTION

[76] Inventor: Hans Behr, Lenzhalde 82, 7000 Stuttgart, Germany

[21] Appl. No.: 679,229

[22] Filed: Apr. 22, 1976

[30] Foreign Application Priority Data

Apr. 22, 1975 Germany ..... 2517716

[51] Int. Cl.[2] ..... B05B 7/00

[52] U.S. Cl. ..... 239/222.17; 239/240

[58] Field of Search ..... 239/15, 225, 226, 240, 239/222.17, 214.13, 214.15, 214.25, 106, 223

[56] References Cited

U.S. PATENT DOCUMENTS

| | | | |
|---|---|---|---|
| 894,059 | 7/1908 | Rosborough | 239/240 |
| 1,725,012 | 8/1929 | Meurer | 239/240 X |
| 1,944,043 | 1/1934 | Titmas | 239/214.13 |
| 2,108,872 | 2/1938 | Swallow | 239/214.13 |
| 2,175,310 | 10/1939 | Pontius, Jr. | 239/214.13 |
| 3,408,985 | 11/1968 | Sedlacsik, Jr. | 239/15 X |

*Primary Examiner*—John J. Love
*Attorney, Agent, or Firm*—Craig & Antonelli

[57] ABSTRACT

A spray nozzle construction which includes a nozzle holder, a nozzle sleeve enclosing the nozzle holder, a nozzle cap arranged at a front end of the nozzle holder, and an annular channel, formed by the nozzle sleeve and nozzle cap, extending outwardly in a radial and axial direction. The nozzle cap is freely rotatable about the axis of the nozzle construction with a pneumatic drive being provided for rotatably driving the nozzle cap.

28 Claims, 4 Drawing Figures

IV
IV

NOZZLE CONSTRUCTION

The present invention relates to a nozzle construction, and more particularly to a circular or ring-shaped spray nozzle construction for spraying aerosols or mist which includes a nozzle holder, a nozzle sleeve enclosing the nozzle holder, and a nozzle cap arranged at a front end of the nozzle holder with an annular channel being formed by the nozzle sleeve and nozzle cap which channel opens to the outside in a radial and axial direction.

A nozzle construction of the aforementioned type has been proposed for use in electrostatic spray booths with fully automatic dye or lacquer feeding wherein the dye or lacquer is dispersed in the form of a mist by way of compressed air. The proposed nozzle construction includes a nozzle holder which has a stepped configuration so as to define shoulders which are threaded to releasably secure the elements of the nozzle construction to each other. Bores are provided about the circumference of the nozzle holder for feeding the dispersion medium to the annular dispersion chamber defined between the nozzle sleeve and nozzle cap. In use, a small, though not negligible, amount of droplets accumulated at the nozzle cap and were not propelled outwardly by the annular jet forming the wide open spray cone. As a result of the accumulated spray droplets, it was impossible to rapidly clean the nozzle cap each time a change of dye or lacquer was required and a slight deviation in color occurred when a new dye or lacquer was first applied. In some instances not only the nozzle cap but also the nozzle sleeve is occasionally hit by stray droplets which also adhere thereto thereby further impairing the rapid change of the dye or lacquer when required.

The aim underlying the present invention essentially resides in improving the aforementioned nozzle construction. For this purpose, a nozzle cap is mounted so as to be rotatable about the nozzle axis with a pneumatic drive means being arranged so as to rotatably drive the nozzle cap. By virtue of this construction, any spray droplets which would normally adhere to a stationary nozzle cap will be thrown off the rotatable nozzle cap due to the centrifugal force. Consequently, the nozzle cap of the present invention will always remain clean and free from dye or lacquer so that, for example, a rapid change of the dye or lacquer can readily be accomplished.

According to one feature of the present invention, at least two ball bearing assemblies are provided for rotatably mounting the nozzle cap with a turbine element serving as a drive for the nozzle cap. Preferably, the turbine element is essentially designed as a radial turbine and is fashioned as a part of the nozzle cap so that the nozzle cap simultaneously acts as a wheel of the radial turbine. By virtue of this arrangement, it is possible to reach a nozzle cap rotational speed of approximately 100,000 rpm.

In accordance with another feature of the present invention, the nozzle cap is provided with rotor blades on a side thereof facing the nozzle holder with the blades defining tangentially extending slots each of which include a slot base extending in a radial direction.

According to a further feature of the present invention, the dispersion channel extends essentially in a radial and also in a somewhat axial direction so as to form a wide cone-shaped shell with the nozzle cap defining, on its rear side, a cone-shaped surface cut by the tangentially extending slots.

Another feature of the present invention resides in threadably arranging a nozzle member on a front portion of the nozzle holder which member rotatably supports the nozzle cap and is supplied with at least a portion of the dispersion medium through bores in the nozzle holder. Preferably, the nozzle member together with the blades of the nozzle cap form a second annular channel which has the same cone-shaped opening angle as the first annular channel for permitting a discharge or exiting of an internal gas stream into the dye or lacquer mist. By virtue of this arrangement, the formation of spray droplets which may enter the air space in front of the nozzle and reach the nozzle cap is avoided from the very start. In order to ensure that the gas stream carrying the cone-shaped mist or aerosols will also follow the lines of the cone, the tangentially extending slots preferably terminate at a flange provided on a rear surface of the nozzle cap.

A still further feature of the present invention resides in providing the nozzle member with a cylindrical pin member for rotatably mounting the nozzle cap with a plurality of bores being evenly distributed about the base of the cylindrical pin member which bores extend in the forward direction. Preferably, the axes of the bore hole intersect the nozzle axis at one point and are located in the second annular channel with the ends of the axes terminating either in the second annular channel or in a further bore provided in the nozzle member with the evenly distributed bores being in communication with bores provided in the nozzle holder.

According to still another feature of the present invention, an approximately cylindrical internally profiled funnel is provided which forms, together with the front end of the nozzle sleeve, a third annular channel for discharging or exiting of an external gas stream which has the same cone-shaped opening as the first and second channels with the front end of the third channel bordering on the first annular channel. The external gas stream forms a guide stream and serves to prevent the settling of droplets on the stationary nozzle sleeve.

Accordingly, it is an object of the present invention to provide a nozzle construction which avoids the aforementioned shortcomings and drawbacks encountered in the prior art.

Another object of the present invention is to provide a nozzle construction which permits a rapid change of the dispersion material in use without an external soiling of the nozzle elements.

A further object of the present invention resides in providing a nozzle construction which will prevent the adherence of droplets to the nozzle cap.

Still another object of the present invention resides in providing a nozzle construction which can readily be installed and removed without any difficulties.

These and other objects, features, and advantages of the present invention will become more apparent from the following description when taken in connection with the accompanying drawing which shows, for the purposes of illustration only, one embodiment of a nozzle construction in accordance with the present invention, and wherein.

Figure 1:
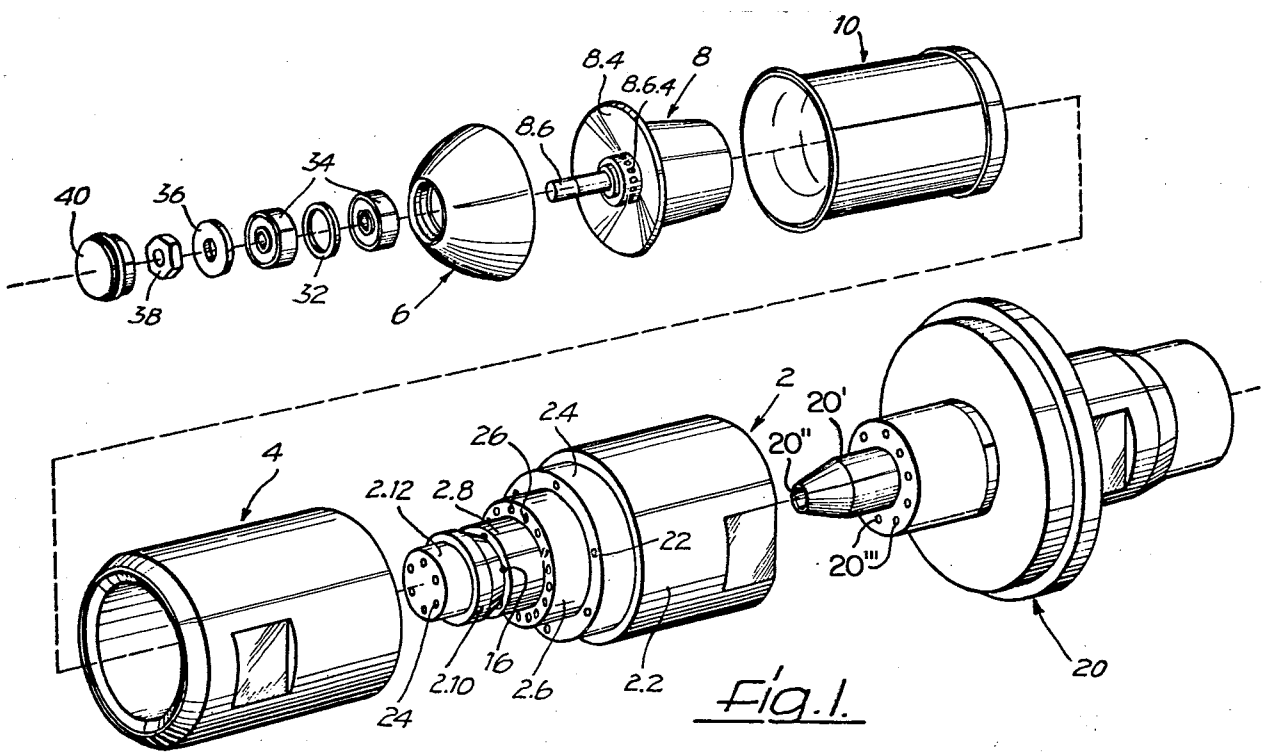
FIG. 1 is an exploded perspective view of a nozzle construction in accordance with the present invention.

Referring now to the drawings wherein like reference numerals are used throughout the various views to designate like parts, and more particularly to FIG. 1, according to this figure, a nozzle construction is provided which includes a nozzle holder generally designated by the reference numeral 2, a nozzle sleeve generally designated by the reference numeral 4, a nozzle cap generally designated by the reference numeral 6, a nozzle member generally designated by the reference numeral 8 disposed between the holder 2 and the cap 6, and a funnel generally designated by the reference numeral 10 arranged between the nozzle member 8 and the holder 2.

The nozzle holder 2 includes a main section or part 2.2, a fastening shoulder 2.4 for fastening the nozzle sleeve 4 to the main section 2.2, a fastening shoulder 2.6 for fastening the funnel 10 to the main section 2.2, an intermediate section or piece 2.8, a fluid supply section 2.10, and a further fastening shoulder 2.12 for fastening the nozzle member 8 to the nozzle holder 2.

The fluid supply section 2.10 is provided with a saw-tooth shaped slot or recess 2.10.2 (FIG. 2) with a steep radially extending flange of the slot 2.10.2 defining the forward terminal or end portion of the intermediate section 2.8.

The external diameter of the nozzle holder 2, without taking into account the saw-tooth recess or slot 2.10.2, decreases in a stepwise fashion with the main section 2.2 of the nozzle holder 2 having the largest external diameter thereby defining the fastening shoulders 2.4, 2.6 and 2.12. To facilitate the interconnection of the elements at the nozzle holder 2, the fastening shoulders 2.4, 2.6, and 2.12 are each provided with an external threaded portion with corresponding internal threaded portions being provided at the sleeve 4, nozzle cap 6, and nozzle member 8, respectively, whereby these latter elements are secured to the nozzle holder 2.

Figures 2, 3, 4:
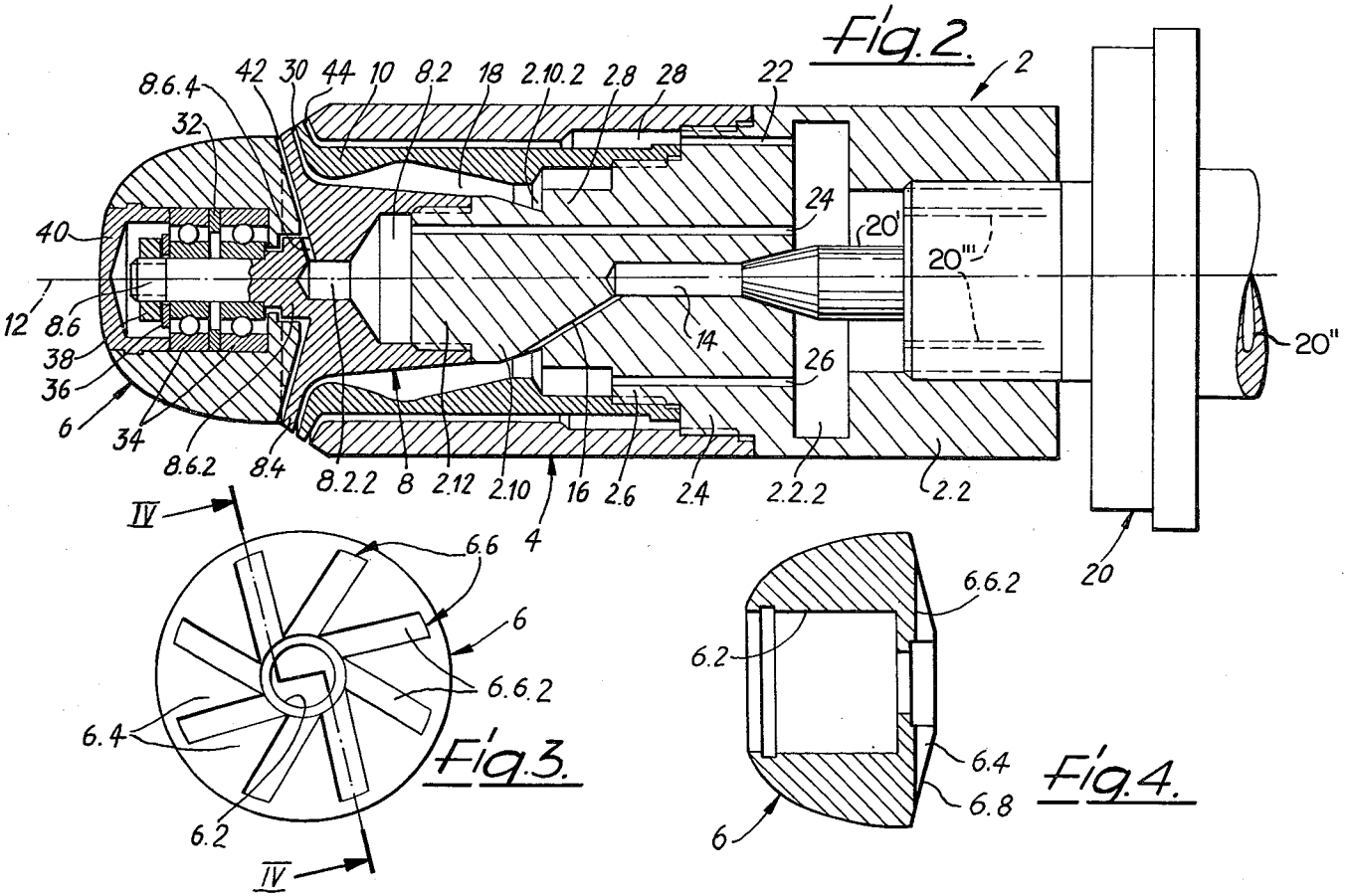
FIG. 2 is a longitudinal cross-sectional view through an assembled nozzle construction of FIG. 1.
FIG. 3 is a detailed view of a rear side of a nozzle cap in accordance with the present invention.
FIG. 4 is a cross-sectional view of the nozzle cap of FIG. 3 taken along the line IV—IV.

As shown most clearly in FIG. 2, an axially extending pocket bore 14 is provided in the main section 2.2 of the nozzle holder 2 and terminates in the intermediate section 2.8. The axial bore 14 has a substantially circular cross-section at its forward portion and widens conically at the rear portion thereof. A plurality of slanted bores 16, only one of which is shown in FIG. 2, are evenly distributed about the circumference of the bore 14 at the front portion thereof. The slanted bores 16 extend from the bore 14 and terminate at a flank of the slot or recess 2.10.2. The bores 16 are slightly inclined with respect to the longitudinal axis 12 of the nozzle with the termination of the bores occurring in a dispersion chamber 18 defined by the nozzle holder 2, nozzle member 8 and funnel 10.

A nozzle end section generally designated by the reference numeral 20 is provided with an extension portion 20′ having a conical cross-sectional configuration corresponding to that of the widened conical portion of the axial bore 14. The extension 20 is provided with a supply bore 20″ which communicates a dispersion material supply (not shown) with the axial bore 14. The nozzle end section 20 also supplies a cavity 2.2.2 in the main portion 2.2 with a dispersion medium, for example, compressed air, by way of a plurality of axially extending evenly distributed bores 20‴. The cavity 2.2.2 is connected with an annular channel 28 formed by the nozzle sleeve 4 and funnel 10, with a cavity 8.2 in the nozzle member 8, and with dispersion chamber 18 by way of three groups of bores 22, 24, 26 which are evenly distributed about the holder 2 and which extend axially parallel to the nozzle axis 12.

The nozzle member 8 and the front end of the funnel 10 form a cone-shaped annular channel 30 through which the dispersion chamber 18 opens outwardly and through which a mist or aerosol exits in the form of a wide circular cone.

The nozzle member 8 includes a cone-shaped flange 8.4 which provides a forward boundary surface of the annular channel 30 with a cylindrical pin 8.6 extending forwardly from the flange 8.4. A plurality of radially generally forwardly extending bores 8.6.4 are evenly distributed about the base of the cylindrical pin 8.6. The longitudinal axes or axis of symmetry of each of the bores 8.6.4 extend through or intersect the axis 12 of the nozzle along one section and along another section thereof extend parallel to the front of the flange 8.4. The internal ends of the respective bores 8.6.4 terminate in a pocket bore 8.2.2 which forms a front section of the cavity 8.2 of the member 8.

Two ball bearing assemblies 34 are arranged at the upper end of the pin 8.6 with a spacer or supporting disk 32 being interposed between the ball bearing assemblies. The upper end of the pin 8.6 is provided with an externally threaded portion for receiving a nut 38 thereby axially fastening the bearing assemblies 34 at the pin 8.6. A washer 36 or the like is interposed between the nut 38 and the forward bearing assembly. The outer races of the respective ball bearing assemblies 34 are received in a longitudinally extending bore 6.2 provided in the nozzle cap 6 with such outer races rotatably supporting the nozzle cap. An elastic snap-type cover or lid 40, preferably of a plastic material, is arranged at the end of the nozzle cap 6 for closing off the bore 6.2 at the front end of the nozzle cap.

For weight considerations, the nozzle cap 6 is preferably formed of a plastic material and is rounded off and polished so as to discourage the adherence of spray droplets or particles thereto.

As shown in FIGS. 3 and 4, the rear of the nozzle cap 6, facing the flange 8.4 of the member 8, is provided with a circular blunt cone-shaped surface 6.8 which includes slots generally designated by the reference numeral 6.6. Additionally, rotor blades 6.4 are provided at the surface 6.8 with the slots 6.6 being arranged between the rotor blades 6.4 and extending tangentially of the bore 6.2. Each of the slots 6.6 includes a radially designed slot base 6.6.2. The surface 6.8 and the flange 8.4 define a second annular channel 42 (FIG. 2) which opens uninterruptingly radially outwardly since the slots 6.6 terminate at a position before a flange of the surface 6.8.

The axis of the bores 8.6.4 and the base of the pin 8.6 are arranged so as to lie in the second annular channel 42 with the outer ends of the bores 8.6.4 terminating in the second annular channel 42.

The funnel 10 is, preferably, fashioned as a steel profiled element having an internal profile with the front of the funnel 10 having an enlarged flange which, together with an anterior flange portion of the nozzle 4, form a third annular channel 44 which communicates with and constitutes the discharge of the annular channel 28.

Preferably, the annular channels 30, 42 and 44 each define an identical cone-shaped opening angle with respect to the nozzle axis 12.

In use, a dispersion medium, for example, compressed air, is directed through the bores 20''' into the cavity 2.2.2 and from the cavity through the bores 22, 24 and 26. The material to be dispensed, for example, a dye or lacquer, is directed through the bore 20'' into the axial bore 14 and through the inclined bores 16 to the dispersion chamber 18. At the dispersion chamber 18, the dye or lacquer and the compressed air from the bore 26 result in the formation of a mist which exits the dispersion chamber 18 through the annular channel 30. The compressed air fed through the bores 22 reaches the annular channel 28 and is discharged through the annular channel 44 thereby forming an external carrying or guiding air stream for the mist. The compressed air fed through the bores 24 accumulates in the cavity 8.2 and is then distributed through the bores 8.6.4 so as to form individual air streams directed at the rotor blades 6.4 thereby causing the rotating movement of the nozzle cap 6. The individual air streams from the bores 8.6.4 merge into an internal air stream at the radially extreme end of the annular channel 42 thereby forming an internal guide stream for the stream of mist.

While I have shown and described only one embodiment in accordance with the present invention, it is understood that the same is not limited thereto but is susceptible of numerous changes and modifications as known to a person skilled in the art, and I therefore do not wish to be limited to the details shown and described herein, but intend to cover all such changes and modifications as are encompassed by the scope of the appended claims.

I claim:

1. A nozzle arrangement which includes a nozzle holder and a nozzle cap, the improvement comprising: means for mounting the nozzle cap at a front end of the nozzle holder so as to be rotatable about a longitudinal axis, means for pneumatically rotatably driving the nozzle cap, and a stationary discharge means arranged between the front end of the nozzle holder and the rotatable nozzle cap for discharging a material from the nozzle arrangement such that the material is discharged rearwardly of the rotatable nozzle cap.

2. The arrangement according to claim 1, wherein said discharge means includes a hollow tubular element surrounding a portion of the nozzle holder, a first annular chamber means is formed between said hollow tubular element and the nozzle cap for accommodating a material to be dispersed by the nozzle arrangement, said first annular chamber including a first generally axially extending portion and a second generally radially extending portion defining a cone-shaped discharge for the material accommodated in said first annular chamber.

3. An arrangement according to claim 2, wherein the nozzle construction has a substantially circular cross-sectional configuration.

4. An arrangement according to claim 3, wherein a material to be sprayed is accommodated in said first annular chamber means, and means communicating with said first annular chamber means for forming a mist of the material accommodated in said chamber means, said mist being discharge in a cone-shaped stream from said cone-shaped discharge.

5. An arrangement according to claim 2, wherein said mounting means includes at least one ball bearing means arranged at the nozzle holder.

6. An arrangement according to claim 5, wherein said driving means includes a turbine means.

7. An arrangement according to claim 6, wherein said turbine means is fashioned as a radial turbine.

8. An arrangement according to claim 7, wherein said radial turbine includes a turbine wheel, and wherein the nozzle cap is fashioned as said turbine wheel.

9. A nozzle arrangement which includes a nozzle holder and a nozzle cap, the improvement comprising:

a hollow tubular element for surrounding a portion of the nozzle holder, a first annular chamber means formed between said hollow tubular element and the nozzle cap for accommodating a material to be dispersed by the nozzle arrangement, said first annular chamber including a first generally axially extending portion and a second generally radially extending portion defining a cone-shaped discharge for the material accommodated in said first annular chamber, means for mounting the nozzle cap at a front end of the nozzle holder so as to be rotatable about a longitudinal axis including at least one ball bearing means arranged at the nozzle holder, a radial turbine including a turbine wheel for pneumatically driving the nozzle cap, and wherein the nozzle cap is fashioned as said turbine wheel and includes a rear end surface facing the nozzle holder and a plurality of rotor blades on said rear end surface.

10. An arrangement according to claim 9, wherein a plurality of slots are arranged between said rotor blades, each of said slots being provided with a radially arranged slot base.

11. An arrangement according to claim 10, wherein the nozzle cap includes an axial bore extending therethrough, said plurality of slots extending tangentially from said axial bore.

12. An arrangement according to claim 11, wherein said rear end surface has a circular blunt cone-shaped surface in which said plurality of slots are cut.

13. An arrangement according to claim 12, wherein said rear end surface includes a peripheral flange portion, said flange portion defining terminating points for each of the plurality of slots whereby said slots extend from said axial bore of the nozzle cap and terminate at a position spaced from the periphery of the rear end surface of the nozzle cap.

14. An arrangement according to claim 13, wherein said mounting means further includes a nozzle cap supporting means arranged at the front end of the nozzle holder, said nozzle cap supporting means includes an end surface facing said rear end surface of the nozzle cap and spaced therefrom so as to define a second annular chamber means for accommodating a dispersion medium, and wherein means are provided for directing a supply of a dispersion medium to said second annular chamber means, said second annular chamber means having a cone-shaped discharge an opening angle of which is identical to an opening angle of the cone-shaped discharge of said first annular chamber means such that a discharge from said second annular chamber means forms an internal guide stream for a mist discharged from said cone-shaped discharge of said first annular chamber means.

15. An arrangement according to claim 14, wherein said means for directing a supply of a dispersion medium includes at least one axially extending bore means provided in the nozzle holder for communicating said second annular chamber means with a dispersion medium supply means.

16. An arrangement according to claim 14, wherein said means for directing a supply of a dispersion medium includes a plurality of axially extending bore means evenly distributed in the nozzle holder for communicating said second annular chamber means with a dispersion medium supply means.

17. An arrangement according to claim 15, wherein said nozzle cap supporting means includes a cylindrical pin member insertible into said axial bore of the nozzle cap, said ball bearing means being interposed between said pin member and the nozzle cap, said cylindrical pin member including a base and a free end, and wherein means are provided at said bore means for directing a dispersion medium from said at least one axially extending bore means in the nozzle holder to said second annular chamber means.

18. An arrangement according to claim 17, wherein said means for directing a dispersion medium from said at least one axially extending bore means in the nozzle holder to said second annular chamber means includes a cavity defined between a front end surface of the nozzle holder and a rear portion of the nozzle cap supporting means, and a plurality of bore means disposed about the periphery of said cylindrical pin member at said base end communicating with said cavity, said at least one axially extending bore means terminating in said cavity whereby a dispersion medium is supplied to said second annular chamber means.

19. An arrangement according to claim 18, wherein said plurality of bore means evenly disposed about the periphery of said cylindrical pin member, each of said bore means includes a longitudinal axis which intersect a longitudinal axis of the nozzle arrangement at a single point with each of the longitudinal axis of the bore means lying in said second annular chamber means such that each bore means defines an individual air stream which is directed at said plurality of rotor blades provided on said rear end surface of the nozzle cap to rotatably drive the same.

20. An arrangement according to claim 19, wherein said hollow tubular member is a nozzle funnel arranged at the nozzle holder, a nozzle sleeve means is provided at the nozzle holder for enclosing at least a portion of the nozzle holder and the nozzle funnel, said nozzle funnel and said nozzle sleeve means being arranged such that a third annular chamber means is defined therebetween for accommodating a dispersion medium, said nozzle funnel including an outwardly extending flange portion arranged forwardly of a front end of said sleeve means so as to define a cone-shaped discharge for discharging a dispersion medium accommodated in said third annular chamber means, and wherein means are provided for directing a supply of a dispersion medium to said third annular chamber means, said cone-shaped discharge of said third annular chamber means having an opening angle which is identical to the opening angles of the cone-shaped discharges of said first and said second annular chamber means such that a discharge of a dispersion medium forms an external guide stream for the mist discharged from said cone-shaped discharge of said first annular chamber means.

21. An arrangement according to claim 20, wherein a front end surface of said flange portion of said nozzle funnel defines a rear boundary wall of said cone-shaped discharge of said first annular chamber means and a rear end surface of said flange portion of said nozzle funnel defines a forward boundary wall of said cone-shaped discharge of said third annular chamber means such that the mist discharged out of said cone-shaped discharge of said first annular chamber means is guided away from the nozzle cap and said sleeve means.

22. An arrangement according to claim 1, wherein said pneumatic driving means includes a turbine having a turbine wheel, and wherein the nozzle cap is fashioned as said turbine wheel.

23. An arrangement according to claim 1, wherein the nozzle cap includes a rear end surface facing the nozzle holder, and wherein said pneumatic driving means includes a plurality of generally radially extending rotor blades arranged on said rear surface, and means provided at the nozzle holder for generally radially directing a flow of a fluid at said rotor blades to rotatably drive the nozzle cap.

24. A nozzle arrangement which includes a nozzle holder and a nozzle cap, the improvement comprising:

means for mounting the nozzle cap at a front end of the nozzle holder so as to be rotatable about a longitudinal axis, means for pneumatically rotatably driving the nozzle cap, an axially extending bore means provided in the nozzle holder for directing a flow of material to be discharged at the nozzle cap, a funnel member arranged at the nozzle holder and defining therewith a dispersion chamber means for accommodating a material discharged at the nozzle cap, at least one inclined bore means for communicating said axially extending bore means with said dispersion chamber means, said dispersion chamber means is provided with a substantially cone-shaped discharge means for discharging material accommodated therein rearwardly of the rotatable nozzle cap, and means in the nozzle holder for supplying a dispersion medium to said dispersion chamber means such that a material accommodated therein is in the form of a mist which is discharged from said cone-shaped discharge means of said dispersion chamber means.

25. An arrangement which includes a nozzle holder and a nozzle cap, the improvement comprising:

means for mounting the nozzle cap at a front end of the nozzle holder so as to be rotatable about a longitudinal axis, means for pneumatically rotatably driving the nozzle cap, an axially extending bore means provided in the nozzle holder for directing a flow of material to be discharged at the nozzle cap, a funnel member arranged at the nozzle holder and defining therewith a dispersion chamber means for accommodating a material discharged at the nozzle cap, at least one inclined bore means for communicating said axially extending bore means with said dispersion chamber means, said dispersion chamber means is provided with a substantially cone-shaped discharge means for discharging therefrom material accommodated therein, means in the nozzle holder for supplying a dispersion medium to said dispersion chamber means such that a material accommodated therein is in the form of a mist which is discharged from said cone-shaped discharge means of said dispersion chamber means, the nozzle cap includes a rear end surface facing the nozzle holder, said pneumatic driving means includes a plurality of rotor blades arranged on said rear surface, and means provided at the nozzle holder for directing a flow of a fluid at said rotor blades to rotatably drive the nozzle cap.

26. An arrangement according to claim 25, wherein said mounting means includes a nozzle cap supporting means arranged at the front end of the nozzle holder, said nozzle cap supporting means including an end surface facing said rear end surface of the nozzle cap and shaped therefrom so as to define an annular chamber means for accommodating a dispersion material, means are provided for directing a supply of a dispersion medium to said annular chamber means, said annular chamber means having a cone-shaped discharge for discharging dispersion material accommodated therein, said cone-shaped discharge having an opening angle which is identical to an opening angle of the cone-shaped discharge of said dispersion chamber means such that a discharge from said annular chamber means forms an internal guide stream for the mist discharged from said cone-shaped discharge of said dispersion chamber means.

27. An arrangement according to claim 26, wherein a nozzle sleeve means is provided at the nozzle holder for enclosing at least a portion of the nozzle holder and the funnel member, said funnel member and said nozzle sleeve means being arranged such that a further annular chamber means is defined therebetween for accommodating a dispersion medium, means are provided for directing a supply of a dispersion material to said further annular chamber means, said further annular chamber means including a cone-shaped discharge for discharging a dispersion medium accommodated therein, said cone-shaped discharge of said further annular chamber means having an opening angle which is identical to the opening angles of the cone-shaped discharges of said dispersion chamber means and said annular chamber means such that a discharge of a dispersion medium forms an external guide stream for the mist discharged from said cone-shaped discharge of said dispersion chamber means.

28. A nozzle arrangement which includes a nozzle holder and a nozzle cap, the improvement comprising:

means for mounting the nozzle cap at a front end of the nozzle holder so as to be rotatable about a longitudinal axis, means for pneumatically rotatably driving the nozzle cap, a discharge means arranged between the nozzle cap and the nozzle holder for discharging a material from the nozzle arrangement, means provided at one side of the material discharge means for directing an internal guide stream for the discharged material, and means provided on another side of said material discharge means for directing an external guide stream for the discharged material whereby the discharged material is directed away from the nozzle cap and the nozzle holder.

* * * * *